US009718662B2

(12) United States Patent
Becker

(10) Patent No.: US 9,718,662 B2
(45) Date of Patent: Aug. 1, 2017

(54) DISPENSER HEAD FOR A BEVERAGE CASK

(71) Applicant: CMB Schankanlagen GmbH, Krefeld (DE)

(72) Inventor: Carl Meinhard Becker, Ratingen (DE)

(73) Assignee: CMB Schankalagen GmbH, Krefeld (DE)

( * ) Notice: Subject to any disclaimer, the term of this patent is extended or adjusted under 35 U.S.C. 154(b) by 0 days.

(21) Appl. No.: 15/117,818

(22) PCT Filed: Jan. 23, 2015

(86) PCT No.: PCT/EP2015/051385

§ 371 (c)(1),
(2) Date: Aug. 10, 2016

(87) PCT Pub. No.: WO2015/121050

PCT Pub. Date: Aug. 20, 2015

(65) Prior Publication Data

US 2017/0008748 A1 Jan. 12, 2017

(30) Foreign Application Priority Data

Feb. 11, 2014 (DE) ..... 10 2014 101 652

(51) Int. Cl.
*B67D 7/84* (2010.01)
*B67D 1/08* (2006.01)
(Continued)

(52) U.S. Cl.
CPC ..... *B67D 1/0831* (2013.01); *B67D 1/0004* (2013.01); *B67D 1/0081* (2013.01);
(Continued)

(58) Field of Classification Search
CPC ..... B67D 1/0831; B67D 1/004; B67D 1/0081
(Continued)

(56) References Cited

U.S. PATENT DOCUMENTS 2,638,914 A 5/1953 Flaith et al.
3,473,556 A * 10/1969 Marine ..... B67D 1/0832 137/212
(Continued)

FOREIGN PATENT DOCUMENTS

DE 2716394 A1 11/1977
EP 0294095 A1 12/1988
(Continued)

*Primary Examiner* — Patrick M Buechner
*Assistant Examiner* — Jeremy W Carroll
(74) *Attorney, Agent, or Firm* — The Webb Law Firm

(57) ABSTRACT

Provided herein is a dispenser head for a beverage cask which has a valve head with a spring-loaded valve disc. The dispenser head includes a housing, a connection element for fastening the housing to the valve head of the beverage cask, a propellant gas inlet, configured on the housing, for connecting a propellant gas line, a ram which is mounted movably in the housing and contains a riser duct and which, by pressing into the valve head, opens the spring-loaded valve disc, a liquid outlet for connecting a beverage line and an actuating mechanism for actuating the ram. The actuating mechanism is configured as a rotational mechanism which has a spiral gearing and a hand wheel connected to the ram and to the spiral gearing.

12 Claims, 4 Drawing Sheets

(51) Int. Cl.
*B67D 1/00* (2006.01)
*B67D 1/04* (2006.01)

(52) U.S. Cl.
CPC ..... *B67D 1/0412* (2013.01); *B67D 1/0832* (2013.01); *B67D 1/0835* (2013.01)

(58) Field of Classification Search
USPC ..... 222/173, 400.7, 400.5; 137/212
See application file for complete search history.

(56) References Cited

U.S. PATENT DOCUMENTS

| | | | | | |
|---|---|---|---|---|---|
| 3,596,809 | A * | 8/1971 | Taubenheim | ..... | B67D 1/0831 137/212 |
| 4,002,273 | A * | 1/1977 | Golding | ..... | B67D 1/0832 222/400.7 |
| 4,180,189 | A * | 12/1979 | Zurit | ..... | B67D 1/0832 137/212 |
| 6,367,667 | B1 | 4/2002 | Ipsen | | |

FOREIGN PATENT DOCUMENTS

| | | | |
|---|---|---|---|
| EP | 0521461 | A2 | 1/1993 |
| GB | 914092 | | 12/1962 |
| GB | 1132222 | | 10/1968 |
| WO | 9915457 | A1 | 4/1999 |

* cited by examiner

DISPENSER HEAD FOR A BEVERAGE CASK

CROSS-REFERENCE TO RELATED APPLICATIONS

This application is the United States national phase of International Application No. PCT/EP2015/051385 filed Jan. 23, 2015, and claims priority to German Patent Application No. 10 2014 101 652.1 filed Feb. 11, 2014, the disclosures of which are hereby incorporated in their entirety by reference.

BACKGROUND OF THE INVENTION

Field of the Invention

The invention relates to a dispenser head for a beverage cask, in particular a beer keg, which has a valve head with a spring-loaded valve disc, comprising a housing, a connection element for fastening the housing to the valve head of the beverage cask, an inlet configured on the housing, for connecting a propellant gas line, a ram which is mounted movably in the housing and which contains a riser duct and opens the spring-loaded valve disc by pressing into the valve head, an outlet for connecting a beverage line and an actuating mechanism for actuating the ram.

Description of Related Art

Dispenser heads of this type for dispensing beverages by means of propellant gas from a cask, in particular from a keg, are known (see for example EP 0 294 095 A1).

A keg is a multiway cask made of stainless steel. On the upper side thereof, it has a centrally arranged valve, the so-called keg head. It is possible to mount thereon an appropriate dispenser head, by which the propellant gas (for example carbon dioxide) can be introduced from a separate container into the cask and the beverage which is thus under excess pressure can be conducted out of the cask to the dispensing system. To be able to quickly assemble the dispenser head, the keg head is usually provided with a flange, onto which the dispenser head, which has a suitable mount with an undercut, is laterally pushed. Arranged in the keg head is an annular valve disc which is pressed by a compression spring into the closed position of the valve. The valve disc surrounds, with a small clearance, the upper end of a riser pipe which extends to the bottom of the beverage cask, the upper end of the pipe being closed by a circular disc which protrudes radially with respect to the pipe and defines a peripheral sealing surface with respect to the valve disc. Closely below the circular disc, the riser pipe has passage openings for the throughflow of the beverage forced out of the cask by the propellant gas. So that the propellant gas which generates an excess pressure can pass into the cask, the annular valve disc is pressed into the keg head against the force of the compression spring by a ram, mounted displaceably in the dispenser head. The ram is tubular. On its lower end facing the annular valve disc, it has a widened diameter, the internal diameter of which is greater than the diameter of the circular disc which is fitted on the upper end of the riser pipe inserted into the cask. The upper end of the ram is formed as a connection for a beverage line leading to the dispensing system. The propellant gas arrives at the keg head via a connecting piece, configured on the housing of the dispenser head and via an annular chamber which is sealed at the top and is defined by the housing and the ram. To actuate the ram, a hand lever is provided which has a fork-shaped portion by which it is swivelably mounted on the housing of the dispenser head (cf. EP 0 294 095 A1 and EP 0 521 461 A2).

Furthermore, generic dispenser heads are also known which are screwed onto the keg head.

In spite of the hand lever, the force to be applied to actuate the ram of a conventional dispenser head of the type mentioned above is high. Furthermore, known dispenser heads of the aforementioned type require a complex locking of the hand lever or ram in the depressed dispensing position to prevent an undesirable resetting of the ram into its upper or retracted position by the compressed compression spring of the keg head.

SUMMARY OF THE INVENTION

An object of the invention was to provide a dispenser head of the type mentioned at the outset which requires considerably less force for actuation than conventional dispenser heads. At the same time, a dispenser head of this type should be economical to produce.

These objects are achieved by a dispenser head described herein.

The dispenser head according to an embodiment of the invention includes an actuation mechanism configured as a rotational mechanism which has a spiral gearing and a hand wheel connected to the ram and to the spiral gearing.

The dispenser head according to the invention can be produced economically and requires only a relatively low force for the actuation of the ram against the spring force of the valve head. Due to the spiral gearing, the dispenser head according to the invention can be actuated much more easily than a conventional dispenser head with a lever mechanism. Furthermore, the spiral gearing of the dispenser head according to the invention does not require an additional device for locking the ram in its lower position which opens the spring-loaded valve disc. The spiral gearing of the dispenser head according to the invention can preferably have a self-locking thread, for example a trapezoidal thread.

The diameter of the hand wheel is preferably the same size as, or greater than the diameter of the valve head (keg head). A correspondingly large hand wheel diameter contributes towards a small expenditure of force and thereby to a simple handling of the dispenser head. On the other hand, with regard to compact dimensions of the dispenser head and to a simple operability thereof, it is favourable if, according to a preferred embodiment, the diameter of the hand wheel is the same size as or is smaller than the diameter of the foot of the housing which can be connected to the keg head.

An advantageous embodiment of the dispenser head according to the invention is characterised in that the liquid outlet (beverage outlet) is arranged on the housing below the hand wheel, the ram having a cross passage which runs into the riser duct and which, in an upper position of the ram, is arranged such that it is sealed and is offset with respect to the liquid outlet, and which is arranged such that it overlaps the liquid outlet in a lower position of the ram in which the ram opens the spring-loaded valve disc. This embodiment allows the dispenser head to be constructed in a compact manner and allows an optimum position of the hand wheel with regard to ergonomically favourable accessibility and operability. The axis of rotation of the hand wheel preferably runs parallel or coaxially to the longitudinal centre axis of the ram.

According to a further embodiment of the invention, the transition of the riser duct into the cross passage is rounded. The transition is thus similar to a pipe elbow. The rounding facilitates the mechanical cleaning of the dispenser head, in particular of the ram, for example by means of sponge balls which are guided or transported for cleaning purposes through the beverage line and the dispenser head.

A further advantageous embodiment of the dispenser head according to the invention provides that the propellant gas inlet is provided with a valve, the movable valve body of which is associated with a control surface formed on the ram, the valve body coming into contact with the control surface during a movement of the ram directed towards the valve head of the beverage cask and being moved out of a closed position into an open position.

In this connection, a further advantageous embodiment of the dispenser head according to the invention provides that the control surface is configured such that the valve body is only moved out of the closed position into the open position when the cross passage of the ram is arranged such that it partly overlaps the liquid outlet. This embodiment ensures that the propellant gas inlet is always closed at the same time as the liquid outlet (beverage outlet) is closed.

The housing and/or the ram and/or the hand wheel of the dispenser head according to the invention are preferably produced from plastics material. This means that the material costs and production costs of the dispenser head can be significantly reduced compared to conventional dispenser heads made of metal. Furthermore, the use of plastics material instead of metal means that the weight of the dispenser head is greatly reduced, which is particularly advantageous with regard to the handling and dispatch of the dispenser head.

According to a particularly preferred embodiment of the dispenser head according to the invention, the housing and ram thereof are produced from transparent or clear plastics material. The dispenser head configured in this way allows a visual check (inspection) of the hygiene or soiling state of the dispenser head without having to dismantle the dispenser head for this purpose.

A further advantageous embodiment of the dispenser head according to the invention is characterised in that the housing has a neck serving as a predetermined breaking point between the connection element used to fasten the housing to the valve head of the beverage cask and the propellant gas inlet. This embodiment ensures that the dispenser head, mounted on the beverage cask, shatters due to a correspondingly strong impact effect during accidental breakage so that the ram or the fragments thereof are released and the spring-loaded valve of the beverage cask can thus close automatically.

A further advantageous embodiment of the dispenser head according to the invention provides that the ram is provided on the lateral surface thereof below the cross passage with a seal which seals off the cross passage from the liquid outlet in the upper position of the ram. This makes it possible to obtain a reliable seal of the liquid outlet when the dispenser head has to be removed from the top of the beverage cask.

According to a further advantageous embodiment, the spiral gearing of the dispenser head according to the invention comprises a threaded sleeve having an inner thread, the inner thread of which is engaged with an outer thread formed in the lateral surface of the housing. This makes it possible to realise a compact and simultaneously smooth-running spiral gearing. In this respect, the hand wheel is preferably connected in a torsionally rigid manner to the threaded sleeve and is connected rotatably to the ram, while the ram is at the same time fixed axially to the hand wheel. The outer thread of the dispenser head housing is configured, for example, as a triple-threaded outer thread, preferably as a outer thread with at least four starts.

A further advantageous embodiment of the dispenser head according to the invention is characterised in that the liquid outlet for connecting a beverage line and the propellant gas inlet for connecting a propellant gas line are arranged on the same side of the housing. This allows a space-saving lay-out of the beverage line and the propellant gas line.

According to a further embodiment of the dispenser head according to the invention, the connection of the hand wheel to the threaded sleeve and to the ram is configured so that in the event of the hand wheel breaking due to a mechanical impact effect thereon, the hand wheel is detached from the threaded sleeve in that a portion of the hand wheel holding a snap ring tears off from the remaining part of the hand wheel and/or a region of the hand wheel which surrounds a flange nut, screwed together with the ram, tears off from the remaining part of the hand wheel so that the ram is automatically moved out of its lower position in which it opens the spring-loaded valve disc into its upper closed position due to the effect of the spring. This provides a reliable self-protection of the dispenser head in the event of a possible breaking-away of the hand wheel due to a mechanical action. In this respect, it is ensured in particular that the propellant gas inlet is automatically closed in such a case.

BRIEF DESCRIPTION OF THE DRAWINGS

In the following, the invention will be described in more detail with reference to drawings which show an embodiment.

DETAILED DESCRIPTION OF THE INVENTION

Figure 5:
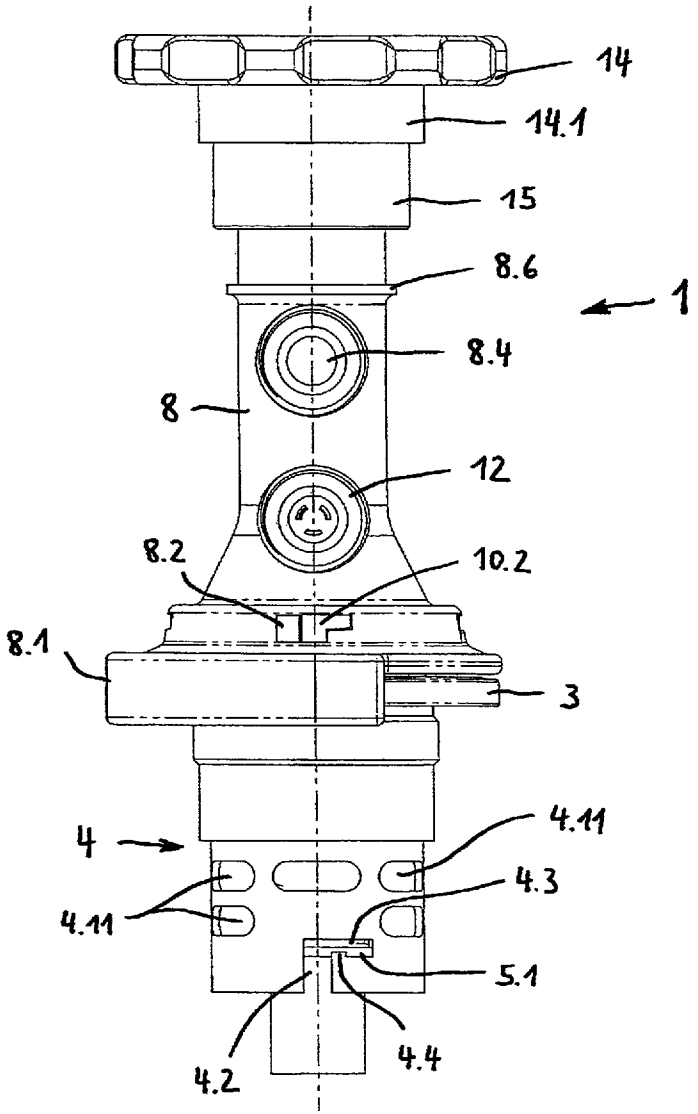
FIG. 5 is a side view of the dispenser head from FIG. 1 connected to the top of a beverage cask.
Figure 7:
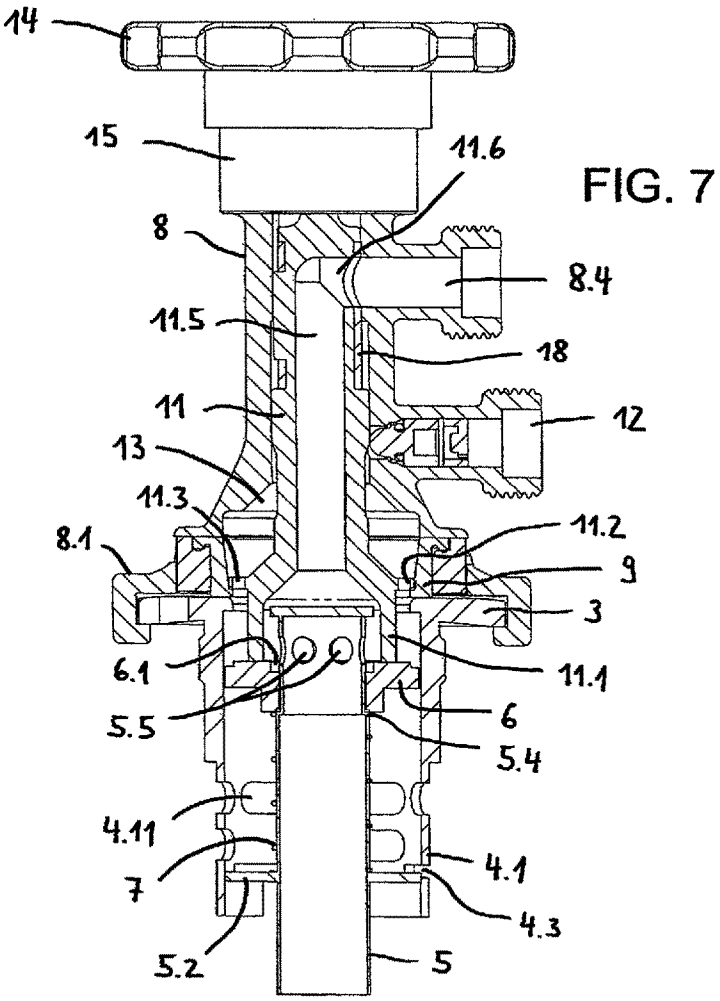
FIG. 7 shows the dispenser head with the top of the beverage cask according to FIG. 6, the hand wheel having been rotated downwards and accordingly the ram projecting into the top of the beverage cask.
Figure 6:
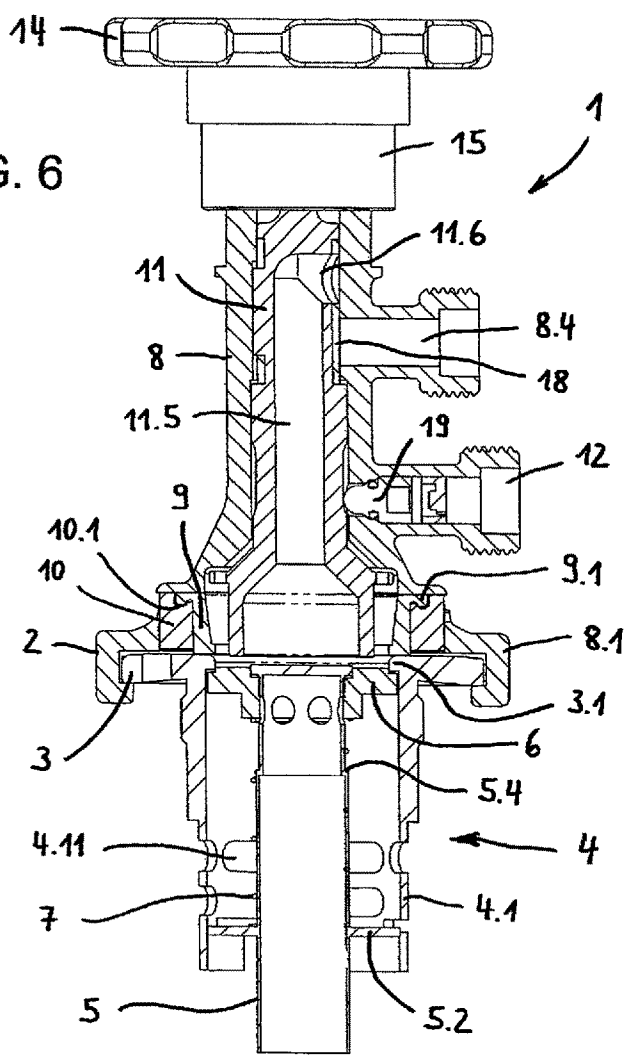
FIG. 6 shows the dispenser head from FIG. 1 connected to the top of a beverage cask, the hand wheel and a threaded sleeve connected thereto being shown in a side view, while furthermore the housing and the ram of the dispenser head and also the top of the beverage cask being shown in an axial sectional view according to FIG. 2.

The dispenser head 1, shown in the drawing, is mounted in a manner known per se on a beverage cask (not shown) by the undercut edge 2 extending over a region of approximately 180° of the housing periphery, in that it is laterally pushed onto the flange 3 of a valve, the so-called keg head 4, arranged on the top of the cask (cf. FIGS. 5, 6 and 7).

The keg head 4 is hollow cylindrical. It is provided with a riser pipe 5 which extends as far as the bottom of the beverage cask, for example beer keg. The riser pipe 5, of which only an upper portion is shown in FIGS. 5, 6 and 7, is detachably connected to the cylindrical connecting piece 4.1 of the keg head by a flange 5.2 having radial projections 5.1. For this purpose, the connecting piece 4.1 has slots 4.2 which run axially on its lower edge and are extended on their upper end in the peripheral direction. The extension 4.3 of the respective slot 4.2 is longer than the slot width measured in the peripheral direction and it has on its lower edge a shoulder with an axially upwardly projecting edge portion 4.4. The radial projections 5.1 of the riser pipe flange 5.2 are fixed on the axially projecting edge portions 4.4 in the manner of a bayonet catch (cf. FIGS. 5 and 6).

On its upper end, the riser pipe 5 has a closed circular disc 5.3 (plate) which projects radially with respect to the outer circumference of the riser pipe 5. The upper end of the riser pipe 5 is surrounded by an annular valve disc 6 which has on its inner circumference a peripheral shoulder 6.1 which rests against or strikes against the underside of the radially projecting edge of the circular disc 5.3. The inner periphery of the keg head flange 3 projects with respect to the internal diameter of the cylindrical connecting piece 4.1 and thereby forms a peripheral stop 3.1 for the valve disc 6 which is pressed against the radially inwardly projecting stop 3.1 by a compression spring 7 which has been introduced into the connecting piece 3 and surrounds the riser pipe 5.

Figure 1:
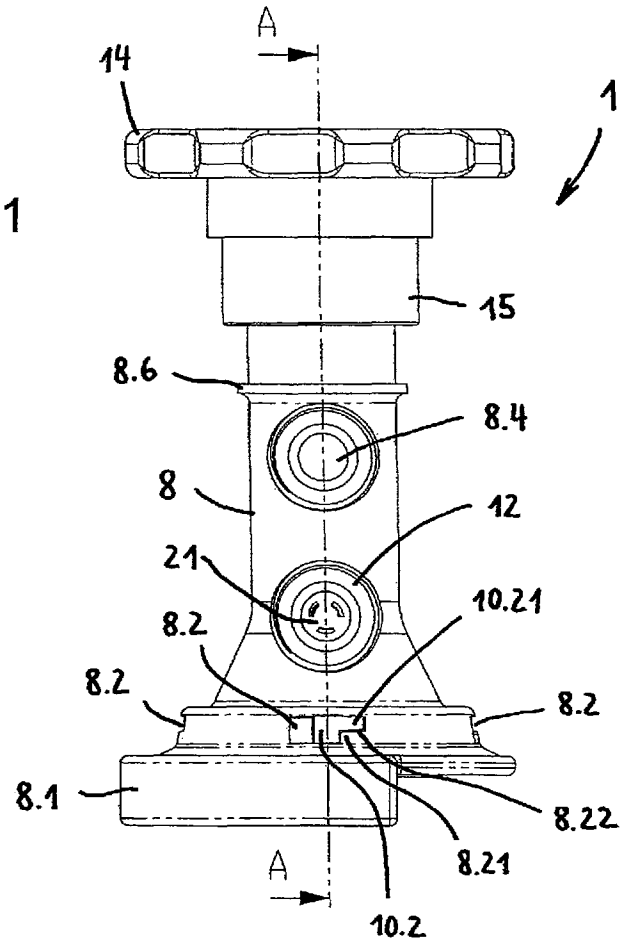
FIG. 1 is a side view of a dispenser head according to the invention for dispensing a beverage from a cask (keg), for example from a beer keg, by propellant gas.
Figure 4:
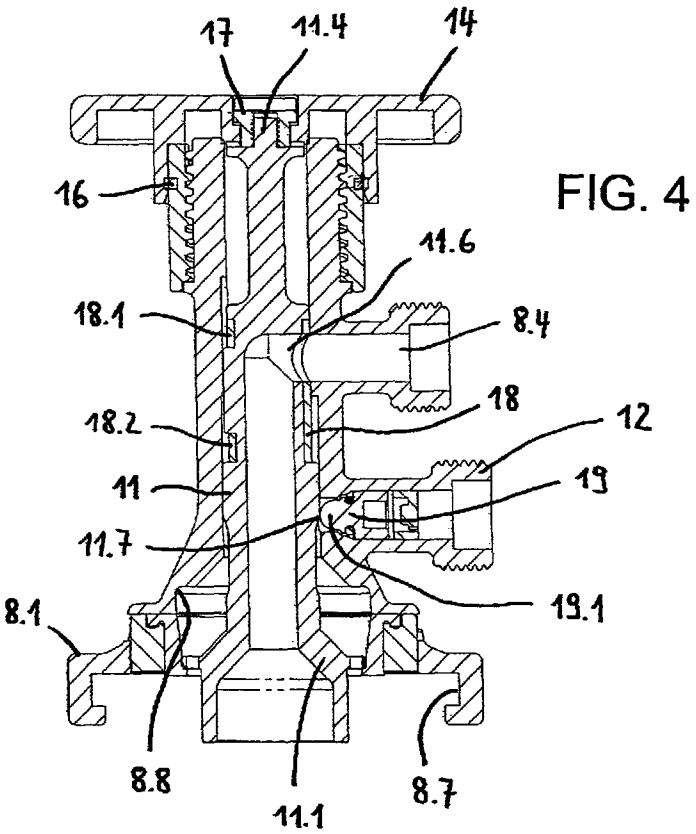
FIG. 4 is an axial sectional view along line B-B in FIG. 3 of the dispenser head from FIG. 3.
Figure 3:
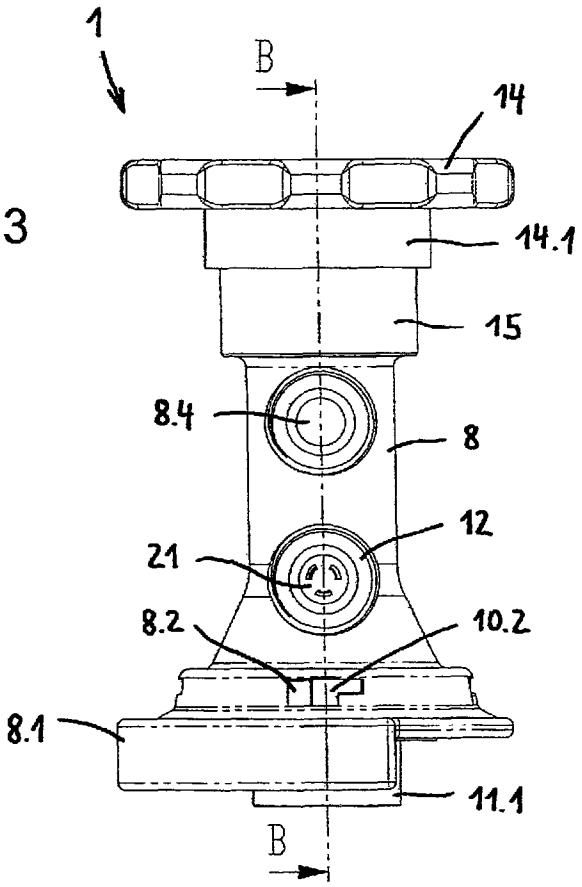
FIG. 3 shows the dispenser head according to FIG. 1, the hand wheel of which has been rotated downwards and accordingly the ram is projecting downwards out of the housing.

Inserted into the foot 8.1, which can be connected to the keg head 4, of the dispenser head housing 8 is an annular seal 9 which, in the assembled state of the dispenser head 1, rests in a sealing manner on the upper side of the flange 3 of the keg head 4 (FIG. 7). The seal 9 is fastened to the inside of the housing foot 8.1 by an annular clamping element 10. For this purpose, the seal 9 has a flange or a collar 9.1 which engages positively in an upper side peripheral shoulder 10.1 of the clamping element 10. The seal 9 is dimensioned such that, when assembled, it slightly projects with respect to the underside of the clamping element 10 (cf. FIG. 2). The clamping element 10 and the housing foot 8.1 are configured in the manner of a bayonet catch. The clamping element 10 is provided on its outer periphery with projections 10.2, with which are associated recesses or window-like openings 8.2 formed in the housing foot 8.1. The recesses or window-like openings 8.2 have a respective shoulder 8.21 with an extension 8.22 which substantially extends in the peripheral direction of the housing 8 and in which a nose-shaped portion 10.21 of the projection 10.2, associated with the recess or opening 8.22 engages, after rotating the clamping element 10 which has been introduced into the housing foot 8.1 (cf. FIGS. 1 and 2).

In its housing 8, the dispenser head 1 has a ram 11 which is arranged such that it can move in an axial direction and by which the annular valve disc 6 of the keg head 4 can be pressed against the force of the compression spring 7 into the connecting piece 4.1 of the keg head 4. At its lower end, the ram 11 has a bell-shaped widening 11.1, the internal diameter of which is greater than the diameter of the upper side circular disc 5.3 of the riser pipe 5 held in the keg head. When the valve disc 6 is pressed down, the bell-shaped widening 11.1 of the ram encompasses the upper end of the riser pipe 5. The riser pipe 5 has a peripheral shoulder 5.4 which, as a stop, restricts the downwardly directed displacement of the valve disc 6 along the riser pipe 5. The thickness of the valve disc 6 and the distance of the shoulder 5.4 from the radially projecting lower edge of the circular disc 5.3 (closing plate) are calculated so that the passage openings 5.5 in the riser pipe 5 which are arranged under the circular disc 5.3 run radially into the bell-shaped widening 11.1 of the ram 11 when the valve disc 6 has been pushed downwards and rests on the shoulder 5.4.

When the ram 11 presses the valve disc 6 onto the shoulder 5.4, propellant gas, for example $CO_2$, which is used to dispense the beverage located in the cask flows from a propellant gas inlet 12, formed in the housing 8 of the dispenser head 1, via the annular space 13, defined by the housing 8 and the outside of the ram 11, into the connecting piece 4.1 of the keg head 4, where the propellant gas passes through the annular gap between the outer circumference of the valve disc 6 and the inner circumference of the connecting piece 4.1 and arrives at the level of the beverage via the passage openings 4.11 in the connecting piece 4.1 which are located above the riser pipe flange 5.2, in order to move said beverage level in the direction of the bottom of the cask.

Figure 2:
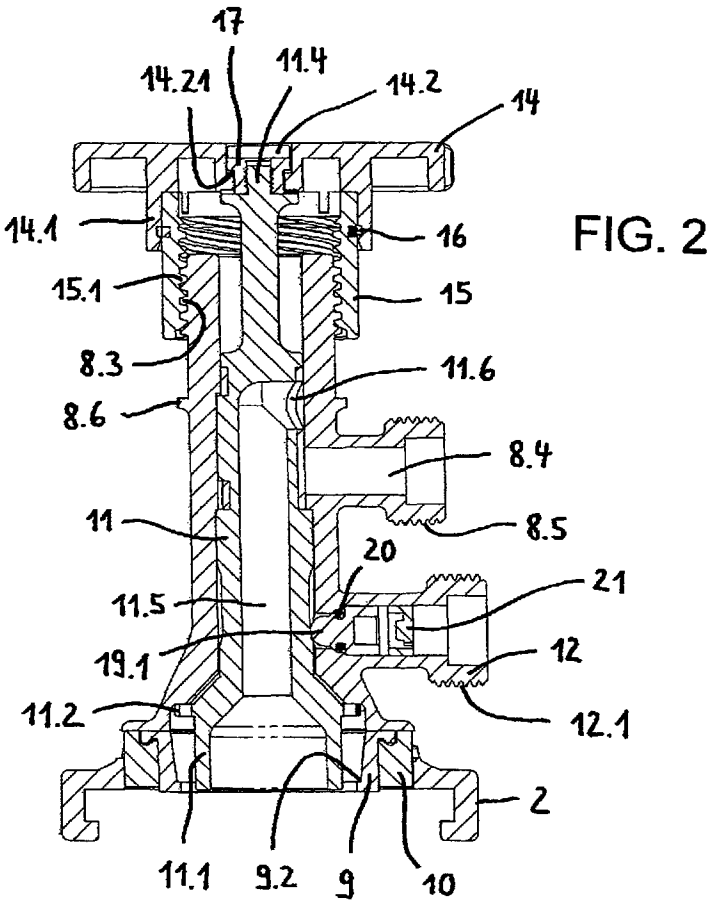
FIG. 2 is an axial sectional view along line A-A in FIG. 1 of the dispenser head from FIG. 1.

To optimise the sealing effect of the seal 9 introduced into the foot 8.1 of the housing, said seal has at the bottom on its inner periphery a peripheral shoulder 9.2, against which the ram 11 presses by a flange 11.2 formed integrally with the outer periphery of its bell-shaped widening 11.1 (cf. FIGS. 2, 5 and 6). Since when resting closely on the seal 9, the flange 11.2 of the ram would block the flow of propellant gas into the cask, the flange 11.2 of the ram is provided with a plurality of axial passage openings 11.3 which ensure the passage of the propellant gas into the connecting piece 4.1 and thereby in the direction of the liquid in the cask even when the flange 11.2 of the ram presses the seal 9 against the flange 3 of the keg head (valve head) 4.

To actuate the ram 11, the dispenser head 1 is provided with a rotational mechanism which comprises a spiral gearing with a hand wheel 14.

The spiral gearing is assembled from an outer thread 8.3, arranged on the upper end of the housing 8 and from a threaded sleeve 15 which has an inner thread 15.1. In the embodiment shown, the outer thread 8.3 has four starts. However, it could also be configured with five or six starts. It can also be seen that the mutually engaging threads 8.3, 15.1 are configured as a trapezoidal thread. The hand wheel 14 is connected in a torsionally rigid manner to the threaded sleeve 15 and is connected rotatably to the ram 11. For this purpose, formed integrally on the underside of the hand wheel 14 is a hollow cylindrical connecting piece 14.1 which surrounds the threaded sleeve 15 on the outside and is connected in a torsionally rigid manner to said threaded sleeve by a catch connection 16. On its upper end, the ram 11 has a bolt-shaped threaded head 11.4, onto which is screwed a flange nut 17 which is received positively with a radial and an axial clearance in a passage hole 14.2, having a peripheral shoulder 14.21, of the hand wheel 14. The ram 11 is thereby fixed axially on the hand wheel 14. Furthermore, the ram 11 is secured or guided in the tubular housing 8 against rotating with respect thereto.

Furthermore, the ram 11 contains a riser duct 11.5 which runs out at the lower end of the ram, namely in the bell-shaped widening 11.1 and extends coaxially to the longitudinal centre axis of the ram 11. The riser duct 11.5 does not run out axially at the upper end of the ram 11, but extends as far as a cross passage 11.6 which leads unilaterally to the lateral surface of the ram 11. The cross passage 11.6 of the ram extends substantially radially and is arranged below the threaded sleeve 15 at an axial distance therefrom. The riser duct 11.5 merges in a rounded manner into the cross passage 11.6.

A liquid outlet or beverage outlet 8.4 which is formed in the wall of the tubular housing 8 is associated with the cross passage 11.6 of the ram 11. The liquid outlet 8.4 is configured as a connecting piece having an outer thread 8.5 and is preferably formed integrally with the housing 8. The liquid outlet (connecting piece) 8.4 is arranged below the hand wheel 14, more specifically below a collar 8.6, serving as a stop for the threaded sleeve 15, of the tubular housing 8. The liquid outlet 8.4 for connecting a beverage line and the propellant gas inlet 12 for connecting a propellant gas line are arranged on the same side of the housing 8.

In the upper position of the ram 11, the cross passage 11.6 thereof is sealed and is arranged offset with respect to the liquid outlet 8.4 (cf. FIGS. 2 and 6), while in the lower position of the ram 11 in which the ram opens the spring-loaded valve disc 6 by pressing down into the connecting piece 4.1 of the keg head 4, the cross passage 11.6 is arranged such that it overlaps with the liquid outlet 8.4 (cf. FIG. 6). The ram 11 is provided with a seal 18 on its lateral surface, below the cross passage 11.6, which seal seals off the cross passage 11.6 from the liquid outlet 8.4 in the upper position of the ram 11. The seal 18 has annular portions 18.1, 18.2 which are spaced apart from each other axially and which are arranged in annular grooves formed in the lateral surface of the ram 11.

The propellant gas inlet 12 is configured as a connecting piece and has an outer thread 12.1. Integrated into the propellant gas inlet (connecting piece) 12 is a valve, the movable valve body 19 of which is associated with a control surface 11.7 formed on the ram 11. During a movement of the ram 11 directed towards the keg head 4, the valve body 19 comes into contact with the control surface 11.7 and is moved out of a closed position into an open position (cf. FIGS. 5 and 6). The control surface 11.7 is configured such that the valve body 19 is only moved out of the closed position into the open position when the cross passage 11.6 of the ram partly overlaps the liquid outlet 8.4. The valve body 19 has a semi-spherical contact head 19.1. The propellant gas inlet (connecting piece) 12 has a constriction on which the valve body 19 rests with a ring seal (O ring) 20 in the closed position of the valve. The valve body 19 is spring-loaded. A compression spring (not shown) which presses the valve body 19 towards the constriction is supported on a holder 21 which defines gas passages and is fixed detachably in the connecting piece 12.

The housing 8, the ram 11, the threaded sleeve 15 and the hand wheel 14 are preferably produced from plastics material, for example from polyethylene (PE), polypropylene (PP) and/or polylactides (PLA). More preferably, at least the housing 8 and the ram 11 are produced from transparent or clear plastics.

The connection of the hand wheel 14 to the threaded sleeve 15 and to the ram 11 is configured such that in the event of the hand wheel 14 breaking due to a mechanical impact effect thereon, the hand wheel becomes detached from the threaded sleeve 15 in that the portion of the hand wheel 14 holding the snap ring 16 tears off from the remaining part of the hand wheel 14 and/or a region of the hand wheel 14, surrounding the flange nut 17, tears off from the remaining part of the hand wheel 14.

Furthermore, it can be seen particularly in FIG. 6 that the housing 8 of the dispenser head 1 has a neck 8.8 serving as a predetermined breaking point between the connection element (housing foot 8.1 with undercut or ring segment-shaped groove 8.7) used to fasten the housing 8 to the keg head 4 and the propellant gas inlet 12.

The diameter of the hand wheel 14 is preferably greater than the diameter of the keg head flange 3 or of the ring segment-shaped groove 8.7 of the housing foot 8.1. On the other hand, in the embodiment shown, the diameter of the hand wheel 14 is smaller than the diameter of the housing foot 8.1 which can be connected to the keg head 4.

The configuration of the invention is not restricted to the embodiment shown in the drawings. In fact, numerous variants are possible which also make use of the invention indicated in the accompanying claims in forms which differ from the illustrated embodiment. Thus for example, the liquid outlet 8.4 can also be arranged on a different side of the periphery of the tubular dispenser head housing 8 than the propellant inlet 12. It is particularly also within the scope of the invention to arrange the liquid outlet 8.4 and the propellant gas inlet 12 on opposite sides of the dispenser head housing 8.

The invention claimed is:

1. A dispenser head for a beverage cask which has a valve head with a spring-loaded valve disc, comprising a housing, a connection element for fastening the housing to the valve head of the beverage cask, a propellant gas inlet, configured on the housing, for connecting a propellant gas line, a ram which is mounted movably in the housing and contains a riser duct and which, by pressing into the valve head, opens the spring-loaded valve disc, a liquid outlet for connecting a beverage line and an actuating mechanism for actuating the ram, wherein the actuating mechanism is configured as a rotational mechanism which has a spiral gearing and a hand wheel connected to the ram and to the spiral gearing, wherein the liquid outlet is arranged on the housing below the hand wheel, the ram having a cross passage which runs into the riser duct and which, in an upper position of the ram, is arranged such that it is sealed and offset with respect to the liquid outlet and which, in a lower position of the ram in which the ram opens the spring-loaded valve disc, is arranged such that it overlaps the liquid outlet.

2. The dispenser head according to claim 1, wherein the riser duct merges in a rounded manner into the cross passage.

3. The dispenser head according to claim 1, wherein the propellant gas inlet is provided with a valve, the valve comprising a movable valve body of which is associated with a control surface formed on the ram, the valve body coming into contact with the control surface during a movement of the ram directed towards the valve head of the beverage cask and being moved out of a closed position into an open position.

4. The dispenser head according to claim 3, wherein the control surface is configured such that the valve body is only moved out of the closed position into the open position when the cross passage of the ram is arranged such that it partly overlaps the liquid outlet.

5. The dispenser head according to claim 1, wherein the housing and/or the ram and/or the hand wheel are produced from a plastic material.

6. The dispenser head according to claim 5, wherein the housing and the ram are produced from a transparent or clear plastic material.

7. The dispenser head according to claim 1, wherein the housing has a neck serving as a predetermined breaking point between the connection element used to fasten the housing to the valve head of the beverage cask and the propellant gas inlet.

8. The dispenser head according to claim 1, wherein the ram is provided on a lateral surface thereof, below the cross passage, with a seal which seals off the cross passage from the liquid outlet in an upper position of the ram.

9. The dispenser head according to claim 1, wherein the spiral gearing comprises a threaded sleeve which has an inner thread and the inner thread of which engages with an outer thread formed in a lateral surface of the housing.

10. The dispenser head according to claim 9, wherein the hand wheel is connected in a torsionally rigid manner to the threaded sleeve and is connected rotatably to the ram, the ram being fixed axially on the hand wheel.

11. The dispenser head according to claim 10, wherein the connection of the hand wheel to the threaded sleeve and to the ram is configured such that, if the hand wheel breaks due to a mechanical impact effect thereon, the hand wheel becomes detached from the threaded sleeve in that a portion of the hand wheel holding a snap ring tears off from a remaining part of the hand wheel and/or a region of the hand wheel, surrounding a flange nut screwed together with the ram, tears off from the remaining part of the hand wheel, so that the ram is automatically moved, due to the effect of the spring, out of a lower position in which the ram opens the spring-loaded valve disc, into an upper closed position.

12. The dispenser head according to claim 1, wherein the liquid outlet for connecting a beverage line and the propellant gas inlet for connecting a propellant gas line are arranged on the same side of the housing.

* * * * *